US007354462B2

(12) United States Patent
O'Rear

(10) Patent No.: US 7,354,462 B2
(45) Date of Patent: Apr. 8, 2008

(54) SYSTEMS AND METHODS OF IMPROVING DIESEL FUEL PERFORMANCE IN COLD CLIMATES

(75) Inventor: Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 152 days.

(21) Appl. No.: 10/264,728

(22) Filed: Oct. 4, 2002

(65) Prior Publication Data

US 2004/0065003 A1 Apr. 8, 2004

(51) Int. Cl.
*C10L 1/10* (2006.01)

(52) U.S. Cl. ..... 44/300; 123/1 A

(58) Field of Classification Search ..... 44/300, 44/393, 40.3; 123/1 A
See application file for complete search history.

(56) References Cited

U.S. PATENT DOCUMENTS 3,620,696 A * 11/1971 Hollyday et al. ..... 44/393
4,240,916 A 12/1980 Rossi
4,359,325 A 11/1982 Dawans et al.
4,533,482 A 8/1985 Bollinger
4,568,663 A 2/1986 Mauldin
4,753,745 A 6/1988 Kostusyk et al.
4,880,553 A 11/1989 Kostusyk et al.
5,955,405 A 9/1999 Liesen et al.
6,056,793 A * 5/2000 Suppes ..... 44/446
6,172,015 B1 1/2001 Emert et al.
6,210,559 B1 4/2001 Cook et al.
6,296,757 B1 10/2001 Wittenbrink et al.
6,402,943 B1 6/2002 Bohlender
6,468,417 B1 10/2002 Biscardi et al.

(Continued)

FOREIGN PATENT DOCUMENTS

EP 0 285 416 A1 10/1988

(Continued)

OTHER PUBLICATIONS

"Low Temperature Operability Additives" from http://www.chevron.com/prodserv/fuels/bulleting/diesel/L2_5_fs.htm dated Oct. 7, 1998.

(Continued)

*Primary Examiner*—Cephia D. Toomer
(74) *Attorney, Agent, or Firm*—E. Joseph Gess

(57) ABSTRACT

Embodiments of the present invention are directed toward systems and methods of providing a low-emissions diesel fuel for use in cold climates. Such fuels may be prepared by a Fischer-Tropsch process and include a pour point depressant. Furthermore, the fuel is used in conjunction with a heated fuel delivery system so that low cloud points are not necessary. Fuels prepared according to embodiments of the present invention may be produced in higher yields than otherwise possible because a higher paraffin wax content can be tolerated, thus obviating the need to remove or exclude the wax. These fuels are characterized by a sulfur content less than 1 ppm, a cetane number greater than 60, an aromatics content less than 1 wt %, and a difference between the cloud and pour points that is greater than about 5° C. The present fuel may be prepared by a Fischer-Tropsch synthesis from any number of carbon-containing sources such natural gas, coal, petroleum products, and combinations thereof.

11 Claims, 1 Drawing Sheet

U.S. PATENT DOCUMENTS

| | | | | |
|---|---|---|---|---|
| 6,468,418 | B1 | 10/2002 | Biscardi et al. | |
| 6,663,767 | B1 * | 12/2003 | Berlowitz et al. | 208/15 |

FOREIGN PATENT DOCUMENTS

| | | | | |
|---|---|---|---|---|
| EP | 0 609 079 | A1 | | 8/1994 |
| EP | 0 921 184 | A1 | | 6/1999 |
| GB | 600367 | A | | 4/1948 |
| GB | 2140319 | A | | 11/1984 |
| JP | 358150069 | | * | 9/1983 |
| WO | WO 00/20535 | A1 | | 4/2000 |
| WO | WO 00/29517 | A1 | | 5/2000 |
| WO | WO 00/60029 | A1 | | 10/2000 |
| WO | WO 01/59034 | | | 8/2001 |

OTHER PUBLICATIONS

Search Report from GB 0323354.1 dated Oct. 14, 2004.
Search and Examination Report from GB 0323354.1 dated Apr. 7, 2004.
Swedish Official Action mailed Nov. 1, 1005.
Netherlands Search Report mailed Apr. 25, 2006.

* cited by examiner 15C
11C
CP
13C
14C
PP
12C 15B
11B
CP
13B
PP
12B
14B 15A
11A
CP
13A
PP
12A
14A
10

SYSTEMS AND METHODS OF IMPROVING DIESEL FUEL PERFORMANCE IN COLD CLIMATES

BACKGROUND OF THE INVENTION

1. Field of the Invention

The present invention relates in general to the use of diesel fuels in cold climates. More specifically, the present invention is directed toward the use of diesel fuels derived from a Fischer-Tropsch synthesis, diesel fuel pour point depressants, and heated fuel delivery systems to improve the performance of diesel fuels in cold climates.

2. State of the Art

Diesel fuels are consumed in virtually every country of the world. Although many of these countries are only subjected to cold climates during their winter seasons, others experience low temperatures year around. It can be a challenge to formulate diesel fuels for cold climates, especially if the objective is to stock only one type of fuel for use during both summer and winter seasons.

The challenge of low temperature operability of the middle distillate fuels stems from the fact that a typical fuel contains paraffin waxes that may precipitate out of solution if the fuel is cooled to a sufficiently low temperature. Paraffin wax is a predominantly straight chain paraffin having the general formula $C_nH_{2n+2}$, where the number of carbons in the molecule is typically greater than about 20.

As a diesel fuel is cooled, it reaches a temperature at which it is no longer able to keep its waxy components in solution. The temperature at which the wax begins to precipitate is known as the "cloud point" because wax crystals become visible as a suspension of small particles, imparting a cloudy appearance to the fuel. When this happens, solid wax particles can plug various elements of a fuel delivery system, most notably the fuel filters. This is not surprising, since fuel filters are designed to remove particulate solids such as grit and other debris that may potentially damage delicate engine parts such as the fuel injectors. Thus, a low cloud point is desirable if one wishes to achieve a steady and uninterrupted flow of fuel through the delivery system.

If the fuel is cooled below the cloud point, more wax can precipitate. At some temperature the viscosity of the fuel increases to a point where the fuel ceases to flow through the fuel lines, and a temperature that is approximately the "pour point" of the fuel has been reached. The pour point may also be a rough indicator of the temperature at which fuel will congeal in the fuel tank. Either of these two situations can be troublesome, if not disastrous, since an interruption in the fuel supply to an operating engine will cause it to cease functioning.

Cloud point and pour point values may be considered simultaneously to suggest a type of cold-climate specification. Typically, the difference between the cloud point and the pour point is less than about 5° C., where the cloud point is the higher of the two temperatures. While some fuel systems become plugged at the cloud point temperature, others can operate several degrees below the cloud point before plugging debilitates the system. This is because low temperature filterability depends on the size and shape of the wax crystals suspended in the fuel, and not merely on whether or not they are present.

Another challenge to contend with in cold geographic locations is getting an engine started in the first place. When attempting to start a cold engine, the heat of compression of the fuel within the combustion chamber is the only energy source available to heat the fuel to a temperature where it can spontaneously ignite (about 750° F.). Initially the walls of the combustion chamber function as a heat sink, rather than a heat source, since they are at a cold ambient rather than hot operating temperature. Furthermore, since the cranking speed of the engine is less than the operating speed, the compression of the fuel is slower initially, allowing more time for the fuel to lose heat to the chamber walls.

The ability to start a cold engine is related to the cetane number of the fuel, which is a measure of the tendency of fuel to combust spontaneously. In the cetane number scale, high values represent fuels that ignite readily, and thus high cetane number fuels perform better in diesel engines. Typically a minimum cetane number of 40 is required to ensure adequate cold starting performance, although higher number are desirable. When ambient temperatures are below freezing, starting aids may be necessary regardless of the cetane number of the fuel.

In addition to concerns about diesel fuel performance in cold-climate situations, there is mounting concern about excessive emissions from diesel engines. Emissions from diesel engines can be reduced if the sulfur content of the fuel is reduced to a level of about one part per million (ppm). Emissions may also be reduced if the aromatic content of the fuel is less than about one weight percent.

One of the techniques available for providing low emission fuels is to produce them from the products of a Fischer-Tropsch process. A Fischer-Tropsch synthesis is a process whereby a starting material called synthesis gas (or "syngas"), which comprises carbon monoxide and hydrogen, is converted to a mixture of long chain hydrocarbons comprising olefins, paraffins, and alcohols. The reaction may be considered a hydrogenative oligomerization of carbon monoxide in the presence of a heterogeneous catalyst, and the reactions have been described by S. Matar and Lewis Hatch in *Chemistry of Petrochemical Processes,* $2^{nd}$ Ed. (Gulf Professional Publishing, Boston, 2001), pp. 121-126.

The Fischer-Tropsch process provides a product that is low in both sulfur and aromatics. Thus, from the standpoint of emissions, the products of the Fischer Tropsch process are ideal. Unfortunately, fuels derived from this source also contain normal paraffins in the form of waxes in the diesel boiling range that solidify at cold temperatures.

To optimize a Fischer-Tropsch fuel for cold climate use, it may be necessary to remove most if not all of the paraffins, especially the highest boiling ones. Normal paraffins are typically treated in an isomerization process that converts them into branched paraffins. However, this conversion is not completely selective, and some of the normal paraffins are converted into light by-products that cannot be blended into the diesel product without compromising the safety of the fuel by simultaneously lowering the fuel's flash point. An alternative solution is to reduce the end point of the diesel fuel, which excludes high boiling normal paraffins by "terminating" the distillation before they have a chance to distill over into the product. End point lowering and conversion techniques for decreasing the wax content are not always desirable as solutions to the wax problem, however, because each of these techniques reduces the yield of the product and hydrocarbon resources are becoming scarce.

What is needed is a diesel fuel designed for use in cold geographic locations and cold climate conditions that may optionally be used in warm weather as well. Such a fuel will have a low sulfur and aromatic content to reduce emissions, and a high cetane number for combustibility. The art lacks a cold climate fuel whose paraffin wax content can be tolerated such that the fuel may be produced in higher yields than otherwise would have been possible.

SUMMARY OF THE INVENTION

A current approach to making low emission fuels suitable for use in cold climates is to hydrogenate the petroleum feedstocks under conditions so severe that the yield of the product is substantially reduced. Such a hydrotreating process is necessary to remove sulfur and aromatic compounds from the fuel, and to increase its cetane number. Another practice that contributes to lower yields involves lowering a distillation endpoint such that higher molecular weight waxy components cannot boil into the product stream, and thus these waxy components are excluded from the final product. The cloud point of the fuel would be higher if these paraffin waxes were to be distilled into the product.

Applicants are unaware of any reference that teaches these elements in combination: a diesel fuel derived from a Fischer Tropsch process with low sulfur content, low aromatic content, and high cetane number; substantially no plugging of fuel filters, substantially no congealing in the fuel tank; and higher production yields than conventional processes. Conventionally, for use in cold climates, Fischer Tropsch-derived diesel fuels are isomerized to a great extent, or the end points reduced to low values. This reduces the yield.

Another parameter that is related to emissions from diesel engines is the cetane number, which describes the ability of a fuel to spontaneously ignite. Normal paraffins have high cetane numbers that increase with molecular weight. Isoparaffins have a wide range of cetane numbers, ranging from about 10 to 80. Molecules with many short side chains have low cetane numbers, whereas those with one side chain of four or more carbons have high cetane numbers. In general, it is desirable for the cetane number to be greater than or equal to about 60, but more preferably may be greater than about 65 or even 70.

According to one embodiment of the present invention, a Fischer-Tropsch derived diesel fuel is provided wherein the fuel comprises a sulfur content less than about 1 ppm; a cetane number greater than about 60; an aromatics content of less than about 1 percent by weight; and a pour point depressant.

Another embodiment of the present invention is directed toward a method of enhancing a Fischer-Tropsch derived diesel fuel, wherein the method comprises adding a pour point depressant in an amount such that the difference between the cloud point and pour point of the fuel is greater than about 5° C. when the pour point is below about 0° C.; and wherein the method comprises passing the diesel fuel through a heated fuel filter when the difference between the ambient temperature and cloud point of the fuel is less than about 2° C. so that filter plugging is substantially avoided. In the latter embodiment, the difference between the ambient temperature and the cloud point of the fuel is less than about 5° C.

DETAILED DESCRIPTION OF THE INVENTION

Figures 1A, 1B, 1C:
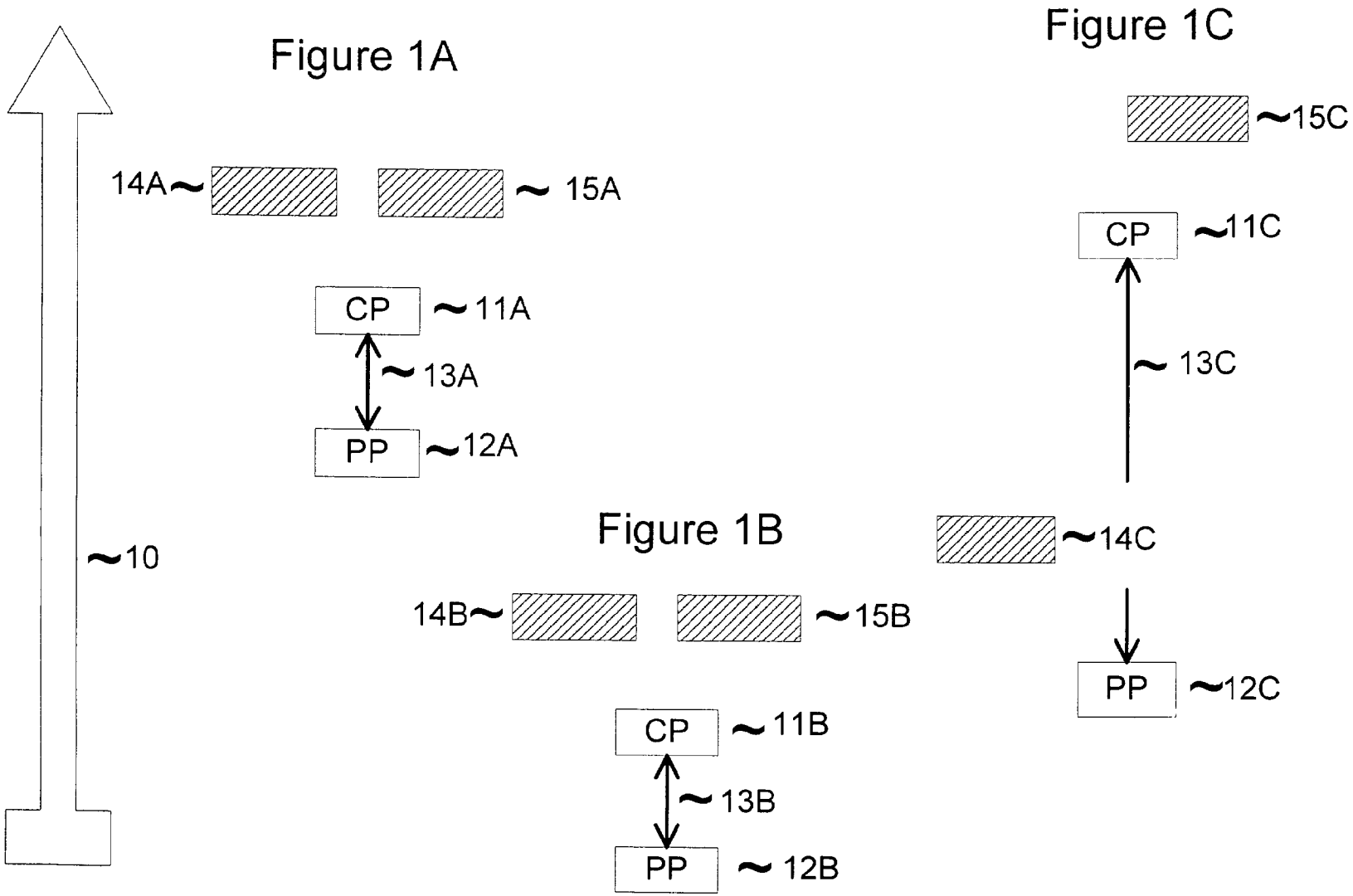
FIG. 1A is a graphical illustration of the difference between the cloud point and the pour point of a conventional fuel being used in a warm climate.
FIG. 1B is a graphical illustration of the difference between the cloud point and the pour point of a conventional fuel being used in a cold climate.
FIG. 1C is a graphical illustration of the difference between the cloud point and the pour point of an exemplary fuel of the present invention being used in a cold climate.

According to embodiments of the present invention, novel methods of providing a low emissions diesel fuel for use in cold climates are disclosed wherein the fuel is synthesized by a Fischer Tropsch process, and the fuel has included in it a pour point depressant. Moreover, the fuel may be transported by a fuel delivery system that is either insulated, and/or has at least a portion of that system heated.

One portion of the delivery system that may be heated is the fuel filter. When an engine is equipped with a heated fuel filter, there is no longer a need to furnish fuels with reduced cloud points. Thus, it is possible to produce fuels in higher yields than otherwise would have been possible because the paraffin waxes do not have to be removed. When a pour point depressant is included in the composition as well, then potential problems with the fuel congealing in the fuel tank are alleviated, and such a fuel flows freely in the fuel delivery system even in cold weather.

a A Fischer-Tropsch derived diesel fuel according to the present invention is characterized by:

b a sulfur content less than about one ppm;

c an aromatic content less than about one percent by weight;

d a cetane number greater than about 60; and e a difference between the cloud point and the pour point of greater than about 5° C.

Embodiments of the present invention include the use of heated fuel filters, the use of pour point depressants, and the production of diesel fuels from a Fischer-Tropsch process. Each of these embodiments are known separately in the art, but not in combination. The cloud point and pour point of a fuel will be defined in more detail shortly, for now it is sufficient to say that the cloud point is higher than the pour point, and that a cloud point/pour point difference of greater than about 5° C. is an indication that 1) the paraffin waxes have not been removed (or completely removed) from the fuel, and 2) that the fuel contains a pour point depressant.

The objectives of the present embodiments include fuel production in high yields, low emissions during fuel combustion, easy engine starting, and the ability of the engine to tolerate a paraffin wax content in the fuel when the fuel is being used in cold climates. Preferably the fuel ignites easily in cold temperatures. Diesel engines and fuel delivery systems using the present fuel have the ability to tolerate a certain content of a paraffin wax in cold climates, and this allows the fuel to be produced in higher yields than otherwise would have been possible.

FIGS. 1A-C illustrate the difference between the cloud point and pour point of different fuels being used in warm and cold climates, where the comparison is made in relation to an arbitrary temperature scale shown generally at reference numeral 10. Temperature increases with height on the graph. In FIG. 1A, a conventional fuel is being used in a warm climate. The difference between the cloud point 11A and the pour point 12A is depicted by reference numeral 13A and this difference is about 5° C. for a conventional fuel. Also shown in FIG. 1A is an ambient temperature 14A, which is high because of the warm climate, and a filter temperature 15A that is also high due to the warm ambient temperature.

FIG. 1B illustrates analogous temperature levels for a conventional fuel being used in a cold climate. For this situation the cloud point 11B and the pour point 12B are each lower than in the previous case because paraffin waxes have been removed from the fuel either by isomerizing the long chain normal paraffins, or by reducing the boiling range of the fuel. Since the cloud point 11B and the pour point 12B are reduced by approximately the same amount from their levels in FIG. 1A, the temperature difference 13B is still about 5° C. As one would expect for this cold climate situation, the ambient temperature 14B and the filter temperature 15B are lower than in the warm climate of FIG. 1A., and the filter temperature 15B is about the same as the ambient temperature 14B because there is no filter heater.

FIG. 1C illustrates the situation for an exemplary fuel of the present invention being used in a cold climate. The ambient temperature 14C is at about the same level as 14B, since that fuel too was being used in a cold climate. In the case of the fuel of the present invention, however, none of the paraffin wax content has been removed, and therefore the cloud point 11C is higher than the cloud point 11B. The cloud point 11C may be either higher or lower than the cloud point 11A.

Referring again to FIG. 1C, the pour point 12C is lower than the pour point 12A because the fuel of the present invention contains a pour point depressant and the conventional fuel of FIG. 1A does not. The pour point 12C may be either higher or lower than the pour point 12B, but since the effect of isomerizing the paraffin wax or reducing the distillation end point may be greater at reducing pour point than the reduction caused by a pour point depressant, the pour point 12B is often lower than 12C. In any event the difference 13C between the cloud point 11C and pour point 12C is greater than 5° C., and this is indicative of a fuel composition of the present invention.

Ordinarily a fuel with a high cloud point would not be suitable for cold climate situations because the wax content of the high cloud point fuel has the potential to plug the fuel filter, but the use of a fuel filter heater in accordance with embodiments of the present invention ensures that the filter temperature 15C is higher than the cloud point 11C, and thus the paraffin waxes remain in solution even in a cold climate. In one embodiment the the difference 13C is greater than about 5° C. In another embodiment of the present invention the difference 13C is greater than about 10° C. In yet another embodiment, the difference 13C is greater than about 15° C.

Cold Climate Specifications

Diesel fuel specifications in general are addressed by ASTM D-975, Standard Specification for Diesel Fuel Oils. This specification sets limits or requirements for the values of certain properties, including flash point, viscosity, sulfur content, cetane number, and aromaticity.

The specifications that are pertinent for low temperature diesel fuel to be used in the United States are described in ASTM D-975. This specification describes how temperature, and thus the acceptable cloud point, vary with month and location in the United States. Appropriate values for these properties of diesel fuels for use in countries other than the United States are described in a similar manner in the CONCAWE reports "Motor Vehicle Emission Regulations and Fuel Specifications." Despite the location, cold climate properties should of course be viewed in relation to the typical ambient temperatures for that region.

Details concerning four tests that are used in the industry to quantify low temperature properties will now be presented. These properties are cloud point and pour point, which have been alluded to already, and cold filter plugging point (CFPP) and low temperature flow test (LTFT), which have not been mentioned yet. In some cases the CFPP can be approximated by the cloud point. Further details about cetane number will also be given.

Cloud point and pour point have been defined precisely by J. G. Speight in *Handbook of Petroleum Analysis* (Wiley-Interscience, New York, 2001), p. 459. Speight defines cloud point as the temperature at which paraffin wax or other solid substances begin to crystallize or separate from a solution, imparting a cloudy appearance to the oil when the oil is chilled under prescribed conditions. Pour point has been defined as the lowest temperature at which oil will pour or flow when it is chilled without disturbance under definite conditions. Cloud point is relevant to the steady and uninterrupted flow of the fuel through a the fuel supply system. Pour point is relevant to the congealing of diesel in a fuel tank.

The measurement of cloud point and pour point has been discussed by Speight at pages 144-145 of the above reference. According to these methods, oil is charged to a glass test tube fitted with the thermometer, and the test tube is then immersed in one of three baths containing coolants. The sample is dehydrated and filtered and a temperature 25° C. higher than the anticipated cloud point. It is then placed in a test tube and cooled progressively. The sample is inspected for cloudiness at temperature intervals of 1° C. See ASTM D-97, ASTM D-5327, ASTM D-5853, ASTM D-5949, ASTM D-5950, ASTM D-5985, IP 15, IP 219, and IP 441.

The pour point of petroleum is determined using a similar technique, and it is the lowest temperature at which the oil flows. It is actually 1° C. above the temperature at which the oil ceases to flow. To determine the pour point, the sample is first heated to 46° C. and cooled in air to 32° C. before the tube is immersed in the same series of coolants as used for the determination of cloud point. The sample is inspected at temperature intervals of 2° C. by withdrawing the tube, and holding it in a horizontal positional for 5 seconds. No flow of oil in the tube should be observed during the time interval. See ASTM D-97 and IP 15.

One dynamic test that has been widely accepted in Europe is the Cold Filter Plugging Point of Distillate Fuels (CFPP). In this test, the sample is cooled by immersion in a constant temperature bath. Thus the cooling rate is nonlinear, but fairly rapid, about 40 degree Celsius per hour. The CFPP is the temperature of the sample with 20 ml of the fuel first fails to pass through a wire mesh in less than 60 seconds. CFPP appears to overestimate the benefit obtained from the use of certain additives, especially for North American vehicles.

A similar dynamic test developed in the U.S. is the Low Temperature Flow Test (LTFT). In contrast to the CFPP, the LTFT uses a slow constant cooling rate of one degree Celsius per hour. This rate was chosen to mimic the temperature behavior of fuel in the tank of the diesel truck left overnight in the cold environment with its engine turned off. LTFT has been found to correlate well with low temperature operability field tests.

The cetane number of a diesel fuel measures to the tendency of the fuel to ignite spontaneously. ASTM D 613 is the standard test method for determining the cetane number of a diesel fuel oil. In the cetane number scale, high values represent fuels that ignite readily, and therefore perform better in a diesel engine. Two specific hydrocarbons define the cetane number scale: 2,2,4,4,6,8,8-heptamethylnonane (also called isocetane), which has a cetane number of 15, and n-hexadecane (cetane) which is assigned a cetane number of 100. These hydrocarbons are the primary reference fuels for the method. Originally the cetane number of a fuel was defined as the volume percent of n-hexadecane (cetane number of zero) in a blend of n-hexadecane 1-methylnaphthalene that gives the same ignition delay as the test sample, but when the low reference fuel was changed an equation to keep the cetane number scale consistent with the original standards.

Diesel Fuel Emissions

Emissions from a diesel engine generally include hydrocarbons, carbon monoxide, nitrogen oxides ($NO_X$), particulate matter (PM), and sulfur oxides ($SO_X$). When hydrocarbon fuel is burned with the correct amount of air in a diesel engine, the exhaust gases that are produced comprise predominantly water vapor, carbon dioxide, and nitrogen. Deviations from this ideal combustion lead to the production of volatile organic compounds (VOC's), as well as the emisions listed above. Diesel engines are substantial emitters of particulate matter and oxides of nitrogen, and emit carbon monoxide and volatile organic compounds to a lesser degree.

The sulfur content of diesel fuel affects particulate emissions because some of the sulfur in the fuel is converted to sulfate particles in the exhaust. The fraction converted to particulates varies from engine to engine, but there is in general a linear decrease in particulates as sulfur is reduced. For this reason, the Environmental Protection Agency (EPA) limits the sulfur content of on-road diesel fuel (so called "low sulfur diesel fuel") to 0.05 percent by weight maximum, while some states such as California apply this limit to all vehicular diesel fuel, both on-road and off-road.

The cetane number has an effect on emissions as well. Increasing the cetane number increases fuel combustion and tends to reduce $NO_X$ and particulate emissions. $NO_X$ appears to be reduced in most engines, whereas the reduction of particulate emissions is more engine dependent and does not appear to occur as universally. The effect of increasing the cetane number on the reduction of these emissions may be non-linear in that the effect is most noticeable at low cetane numbers.

Reducing the aromatics content of diesel fuel also reduces $NO_X$ and particulate emissions in some engines. Polynuclear aromatics appear to be more critical to this effect than single ring aromatic compounds.

Fischer-Tropsch Process

The Fischer-Tropsch process was adapted as a means to convert natural gas into liquid fuels, but Fischer-Tropsch derived fuels may be prepared from any number of carbon-containing sources, including natural gas, coal, petroleum products, and combinations thereof. For this reason the process is also known as a "gas-to-liquids" conversion. In a modern implementation of the Fischer-Tropsch process natural gas, which is mostly methane, is reacted with air over a first catalyst to create synthesis gas, which is a mixture of carbon monoxide and hydrogen. This gas mixture, also known as "syngas," is then converted into diesel boiling range liquid hydrocarbons using a second catalyst. The material produced from this process has many beneficial attributes, including a high cetane number, and essentially no sulfur or aromatic content.

The Fischer-Tropsch process provides a product that is low in sulfur and aromatic content, with sulfur being typically below 1 ppm (part per million) and the aromatic content being below about one percent by weight. The products from a Fischer-Tropsch process are typically hydrogenated to remove traces of olefins and oxygenates, and this results in a product that contains mostly paraffins. Usually the product contains more than about 90 percent by weight paraffins, but can contain greater than 95 percent by weight, and even greater than about 98 percent by weight paraffins. Unfortunately, one type of normal paraffin is a wax in the diesel boiling range which can be a solid at cold temperatures. The highest boiling normal paraffins have the highest melting points. Thus, it may be advantageous to remove most if not all of the normal paraffins, especially the highest boiling ones, to use the fuel cold climates, but this reduces production yield.

Normal paraffins are typically removed by an isomerization process that converts them into iso-paraffins. However, the conversion is not 100 percent selective, and during the isomenzation process a portion of the normal paraffins may be converted into light byproducts that cannot be blended into a diesel fuel product while maintaining a safe flash point. Alternatively, the distillation end point of the diesel fuel may be reduced.

Catalysts and conditions for performing Fischer-Tropsch synthesis are well known to those of skill in the art, and are described, for example, in EP 0 921 184 A1, the contents of which are hereby incorporated by reference in their entirety. In the Fischer-Tropsch synthesis process, liquid and gaseous hydrocarbons are formed by contacting a synthesis gas (syngas) comprising a mixture of $H_2$ and CO with a Fischer-Tropsch catalyst under suitable temperature and pressure reactive conditions. The Fischer-Tropsch reaction is typically conducted at temperatures of about 300 to 700° F. (149 to 371° C.), preferably about from 400 to 550° F. (204 to 228° C.); pressures of about 10 to 600 psia (0.7 to 41 bars), preferably 30 to 300 psia (2 to 21 bars) and catalyst space velocities of about 100 to 10,000 cc/g/hr., preferably 300 to 3,000 cc/g/hr. The products of a Fischer-Tropsch process may range from $C_1$ to $C_{200+}$, with a majority of the products in the $C_5$-$C_{100+}$ range.

A Fischer-Tropsch synthesis reaction may be conducted in a variety of reactor types including, for example, fixed bed reactors containing one or more catalyst beds, slurry reactors, fluidized bed reactors, or a combination of different type reactors. Such reaction processes and reactors are well known and documented in the literature. A preferred process according to embodiments of the present invention is the slurry Fischer-Tropsch process, which utilizes superior heat and mass transfer techniques to remove heat from the reactor, since the Fischer-Tropsch reaction is highly exothermic. In this manner, it is possible to produce relatively high molecular weight, paraffinic hydrocarbons.

In a slurry process, a syngas comprising a mixture of $H_2$ and CO is bubbled up as a third phase through a slurry formed by dispersing and suspending a particulate Fischer-Tropsch catalyst in a liquid comprising hydrocarbon products of the synthesis reaction. Accordingly, the hydrocarbon products are at least partially in liquid form at the reaction conditions. The mole ratio of the hydrogen to the carbon monoxide may broadly range from about 0.5 to 4, but is more typically within the range of about 0.7 to 2.75, and preferably from about 0.7 to 2.5. A particularly preferred Fischer-Tropsch process is taught in EP 0 609 079, also completely incorporated herein by reference.

Suitable Fischer-Tropsch catalysts comprise one or more Group VIII catalytic metals such as Fe, Ni, Co, Ru, and Re. Additionally, a suitable catalyst may contain a promoter. Thus, a preferred Fischer-Tropsch catalyst comprises effective amounts of cobalt and one or more of the elements Re, Ru, Pt, Fe, Ni, Th, Zr, Hf, U, Mg, and La on a suitable inorganic support material, preferably a material which comprises one or more of the refractory metal oxides. In general, the amount of cobalt present in the catalyst is between about 1 and about 50 percent by weight of the total catalyst composition. The catalysts can also contain basic oxide promoters such as $ThO_2$, $La_2O_3$, MgO, and $TiO_2$, promoters such as $ZrO_2$, noble metals such as Pt, Pd, Ru, Rh, Os, Ir, coinage metals such as Cu, Ag, and Au, and transition metals such as Fe, Mn, Ni, and Re. Support materials including alumina, silica, magnesia and titania or mixtures thereof may also be used. Preferred supports for cobalt containing catalysts comprise titania. Exemplary catalysts and their preparation may be found, among other places, in U.S. Pat. No. 4,568,663.

As stated previously, Fischer-Tropsch synthesis products include paraffin waxes. The waxy reaction product includes hydrocarbons boiling above about 600° F., which in refinery terminology includes a vacuum gas oil fraction through heavy paraffins, with increasingly smaller amounts of material down to about $C_{10}$. In one embodiment of the invention, the diesel fuel is formulated such that it comprises a 95% point as measured by ASTM D-2887 in excess of 625° F. In another embodiment of the invention, the fuel is formulated such that it comprises a 95% point as measured by ASTM D-2887 in excess of 650° F. In yet another embodiment of the invention, the fuel is formulated such that it comprises a 95% point as measured by ASTM D-2887 in excess of 690° F.

Pour Point Depressants

Conventionally, two general approaches have been taken to address low temperature operability. A first approach is directed toward reducing the wax content of the fuel at the refinery level, and/or treating the fuel with an additive that effectively cancels the adverse effects of the wax presence. For example, diesel fuels may be produced from a crude oil precursor that is inherently low in paraffin wax content. Similarly, the fuel may be manufactured by refining the crude oil to a lower end point, thus avoiding the inclusion of heavier, longer chain paraffin waxes. Alternatively, a first fuel having a high wax content may be blended with a second fuel having a low wax content, thus diluting the concentration of wax in the blend relative to the high level in the first fuel. Finally, a fuel with a high wax content may be treated with an additive that substantially prevents the waxes from precipitating out of solution at low temperatures. The first two approaches strive to avoid a high wax content at the outset, while the latter two either reduce or mitigate the effects of a high wax content.

Pour point depressants are known in the art. These compounds are additives that lower the pour point of a diesel fuel, and thus improve its cold flow properties. Chemically, they are polymers that interact with wax crystals before the waxes can precipitate out of solution. Pour point additives have a long, linear paraffinic component and a branched component. The linear component is incorporated within a particular wax molecule, while the branched component prevents multiple wax molecules from agglomerating (forming a connected structure throughout the hydrocarbon phase). It is the branched component of the pour point depressant that prevents a large wax crystal from solidifying/precipitating, and thus the pour point temperature of the diesel fuel is lowered.

The polymer-wax interactions are fairly specific, so a particular additive generally does not generally perform equally well in all fuels. Furthermore, to be effective, additives should be blended into the fuel before any wax is formed; i.e., when the fuel temperature is still above the cloud point.

There are several classes of branched components:

a fumarates based on alkylation of olefins with maleic anhydride followed by esterification with an alcohol;

b bridged alkylaromatics (naphthalenes) based on alkylation of —AR—$CH_2$—AR— functionalities with olefins and or alcohols;

c acrylates based on alkylation with olefins and possibly alcohols; and d acetates based on reaction of polymeric olefins with acetic acid.

An example of furmarate-based pour point depressants is described in U.S. Pat. No. 4,240,916 which describes an oil-soluble copolymer, useful as a pour point depressant for lubricating oils, and which is composed of about equimolar amounts of 1-olefins and maleic anhydride, the 1 -olefins being in a mixture comprising from about 25 to 75, preferably 30 to 55, mole percent of straight chain $C_{20}$-$C_{24}$ 1-olefins and from about 25 to 75, preferably 45 to 70, mole percent of $C_{10}$-$C_{14}$ 1-olefins. These copolymers are oil-soluble, essentially free of olefinic unsaturation, and have a number average molecular weight of from 1,000 to 30,000. The pour point depressant activity of these copolymers is enhanced by esterification with a $C_1$ to $C_8$ alcohol, an example being 2-ethyl hexanol. The copolymers are usefully admixed with lubricants in an amount of from 0.01 to 3 wt. % based on the total weight of the admixture.

As an example of alkylaromatic pour point depressants is described in U.S. Pat. Nos. 4,880,553 and 4,753,745. The compounds disclosed in these patents may be represented by the general structural formula Ar(R)—[Ar'(R')]$_n$—Ar", where Ar, Ar' and Ar" are aromatic moieties containing 1 to 3 aromatic rings, and where each aromatic moiety is substituted with up to 3 substituents; (R) and (R') represent alkylene group having about 1 to 100 carbon atoms with the proviso that at least one of (R) or (R') is $CH_2$, and n is 0 to about 1000; with the proviso that if n is 0, then (R) is $CH_2$ and each aromatic moiety is independently substituted with 0 to 3 substituents with one aromatic moiety having at least one substituent, the substituents being selected from the group consisting of a substituent derived from an olefin and a substituent derived from a chlorinated hydrocarbon. The composition of the invention includes compounds varying in molecular weight from about 271 to about 300,000.

Examples of acrylate based pour point depressants will now be discussed. U.S. Pat. No. 6,172,015 describes polar monomer-containing copolymers derived from at least one α,β-unsaturated carbonyl compound, such as alkyl acrylates and one or more olefins, such olefins including ethylene and $C_3$-$C_{20}$ α-olefins such as propylene and 1-butene, which copolymers have (a) an average ethylene sequence length of from about 1.0 to less than about 3.0; (b) an average of at least 5 branches per 100 carbon atoms of the copolymer chains comprising the copolymer; (c) at least about 50 percent of the branches being methyl and/or ethyl branches; (d) substantially all of the incorporated polar monomer present at the terminal position of the branches; (e) at least about 30 percent of the copolymer chains terminated with a vinyl or vinylene group; (f) a number average molecular weight, Mn, ranging from about 300 to about 15,000 when the copolymer is intended for dipersant or wax crystal modifier uses and up to about 500,000 where intended for viscosity modifier uses; and (g) substantial solubility in hydrocarbon and/or synthetic base oil. The copolymers are produced using late-transition-metal catalyst systems and, as an olefin monomer source other than ethylene preferably inexpensive, highly dilute refinery or steam cracker feed streams that have undergone only limited clean-up steps. Where functionalization and derivatization of these copolymers is required for such additives it is facilitated by the olefinic structures available in the copolymer chains.

U.S. Pat. No. 5,955,405 describes non-dispersant polymethacrylate copolymers comprising from about 5 to about 15 weight percent butyl methacrylate; from about 70 to about 90 weight percent of a $C_{10}$-$C_{15}$ alkyl (meth) acrylate; and from about 5 to about 10 weight percent of a $C_{16}$-$C_{30}$ alkyl methacrylates for providing excellent low temperature properties to lubricating oils.

U.S. Pat. No. 4,533,482 describes hydrogenated diolefin-lower alkyl acrylate or methacrylate copolymers and the use of these copolymers to improve the viscosity index (VI) of lubricating oils. The preferred copolymer is a fully hydrogenated, high molecular weight copolymer of 1,3-butadiene and methyl methacrylate containing at least about 71 mole percent 1,3-butadiene. A pour point depressant incorporates a higher alkyl methacrylate into the copolymer and is prepared by graft polymerizing a polar, nitrogen-containing graft monomer onto the polymer.

U.S. Pat. No. 4,359,325 describes copolymers comprising acrylic ester, dicarboxylic compounds, and diisobutylene functionalities. The number average molecular weights of these copolymers ranges from 500 to 250,000 are useful for improving the cold-flow properties of lube oils and other hydrocarbon oils such as diesel oil, heavy fuel oil, residual fuel oil and crude petroleum.

Physically, a fuel that has had a pour point depressant added (a so-called "additized fuel") will display a difference between the cloud and pour point of more than 5° C. Chemically, acrylate-based pour point depressants are perhaps the most commonly used in the art, and this is preferred according to at least some of the embodiments of the present invention.

As shown in the examples below, pour point depressants are effective in reducing the pour point, but in general they are not very effective in reducing the cloud point (or the cold-filter plugging point, which is related) when used in fuels at economic levels. Additional solutions to the problems that cloud point present are necessary, and these may include heating one or more of the various fuel delivery system components.

According to one embodiment of the present invention, the difference between the cloud point and the pour point of the fuel is greater than about 10° C., but in another embodiment the difference is greater than about 15° C. In one embodiment of the present invention the cloud point of the fuel is less than about 0° C., but it is less than about −15° C. in another embodiment, and less than about −25° C. in yet another embodiment.

Heated Fuel Systems

The second of the two general approaches taken to address low temperature operability involves heating the fuel at some place within the fuel delivery system. Plant facilities and vehicles may be equipped with fuel tank or fuel filter heaters, and/or insulation around fuel lines or other components of the fuel delivery system. Fuel pumps, filters, and other delivery system components may be positioned adjacent to the engine to facilitate heat transfer from the engine. Another practice involves pumping more fuel to the injectors than the engine actually requires, such that excess fuel, which has now been heated by the engine, can be circulated back to the fuel tank.

Fuel filter heaters are known in the art. Desirable aspects of a heated fuel filter system, according to embodiments of the present invention, are that:

a the filter be heated to a temperature above the cloud point of the fuel;

b the energy be provided from a source within the vehicle, if there is a vehicle, but the energy source may be either internal or external to the engine; and c the fuel filter be sealed to prevent leaking of fuel to the environment.

Preferably the temperature of the filter is an adequate amount above the cloud point of the fuel so that the opportunities for wax plugging within the filter are substantially decreased. According to one embodiment of the present invention, the temperature of the fuel filter is at least 5° C. above the cloud point of the fuel, but in other embodiments the temperature of the fuel in the filter may be at least 10° C., or at least 15° C. higher than the cloud point.

The energy source providing heat to the fuel filter can originate from any number of places, such as the engine's cooling systems, resistive heating sources including glow-plugs, other electrical sources such as a battery, alternator, or other on-board source, crankcase lubricating oils systems, combinations of the above sources, and the like.

The heating of the filter may take place in either a continuous or periodic manner. In an exemplary embodiment, a sensor is employed to detect increases in the pressure drop across the filter, where a large pressure drop would be experienced if solidified wax crystals were to plug the filter, at which time the heater would be activated to drive the wax crystals back into solution. The sensor would operate in a negative feedback loop whereby the decrease in pressure drop as a result of the wax dissolving would cause the heater to shut off until the next cycle. In this manner, it is not necessary to operate the heater continuously.

In another embodiment, multiple methods of providing the heat may be used during different phases of engine use. For example, the filter may be electrically heated during startup, and then later heated by engine heat from the coolant system or the lubricating oil as the engine reaches and maintains operating temperature.

Suitable safety devices may be incorporated into these fuel filter heating systems to prevent over-heating of the fuel delivery system. Over-heating of a fuel system can create a potentially dangerous fire hazard. Such safety devices are known in the art, and include self-regulating heating tape, temperature detectors coupled with shut-off devices, and the like. Using heat from the cooling system or the engine oil reduces the chance of over-heating.

Various embodiments of the present invention are presented in the following examples.

EXAMPLE I

Preparation of a Paraffinic Fischer-Tropsch Diesel Fuel

A blended highly paraffinic feedstock having material boiling in the lighter half of the distillate fuel product, and material boiling above the end point of the product was prepared from three individual Fischer Tropsch components.

TABLE I

Properties of Highly Paraffinic Fischer-Tropsch Feed Components

| Property | Component 1 | Component 2 | Component 3 |
|---|---|---|---|
| Wt % in blend | 27.8 | 23.1 | 49.1 |
| Gravity, ° API | 56.8 | 44.9 | 40.0 |
| Sulfur, ppm | <1 | <1 | |
| Oxygen, ppm by Neut. Act. | 1.58 | 0.65 | |
| Chemical Types, wt % by GC-MS | | | |
| Paraffins | 38.4 | 62.6 | 85.3 |
| Olefins | 49.5 | 28.2 | 1.6 |
| Alcohols | 11.5 | 7.3 | 9.3 |
| Other Species | 0.5 | 3.9 | 3.8 |
| Distillation by D-2887, ° F. by wt % | | | |
| 0.5/5 | 80/199 | 73/449 | 521/626 |
| 10/30 | 209/298 | 483/551 | 666/758 |
| 50 | 364 | 625 | 840 |
| 70/90 | 417/485 | 691/791 | 926/1039 |
| 95/99.5 | 518/709 | 872/1074 | 1095/1184 |

The blend was prepared by continuously feeding the different components down-flow to a hydroprocessing reactor. The reactor was filled with a catalyst containing alumina, silica, nickel, and tungsten. The reactor was sulfided prior to use. The LHSV was varied between 0.7 and 1.4 to explore this effect, the pressure was constant at 1000 psig, and the recycle gas rate was 4,000 SCFB. The per-pass conversion was maintained at approximately 80% below the recycle cut point (665-710° F.) by adjusting the catalyst temperature.

The product from the hydroprocessing reactor (after separation and recycling of unreacted hydrogen) was continuously distilled to provide a gaseous by-product, a light naphtha, a diesel fuel, and an unconverted fraction. The unconverted fraction was recycled to the hydroprocessing reactor. The temperatures of the distillation column were adjusted to maintain the flash and cloud points at their target values of 58° C. for the flash point and −18° C. for the cloud point.

The yield of diesel fuel that could be produced from this feed meeting both flash and cloud point specifications was in excess of 80 wt %. Operation at LSHV of 0.7 increased the allowable end point of the diesel fuel, which in turn increased the yield. It was apparent that operating at a low LHSV increased the isomerization of the heaviest portion of the diesel fuel, which enabled the end point to be increased, and that in turn increased the yield. Thus it is preferable to operate this hydroprocessing unit at 1.5 LHSV or lower, preferably 1.0 LHSV or lower, and most preferably 0.75 LHSV or lower.

From this study, limits on the 95 wt % point of the diesel fuel can also be proposed. As noted previously, it is desirable to maximize diesel yield, and incorporating as much heavy material as possible works to achieve that goal. But the incorporation of heavy material is limited by the diesel cloud point. Incorporation of heavy material increases the capability of the diesel fuel to incorporate light material near the flash point, thus further increasing the yield. Thus the maximum diesel yield is obtained when the product is produced at or near the flash and cloud point specifications, and with as sharp a distillation separation as possible. It is desirable to have the 95% points as measured by ASTM D2887 of a diesel fuel by this process in excess of 625° F., preferably in excess of 650° F. and more preferably in excess of 690° F.

Diesel fuel was blended from several hours of consistent operation at 1.4 LHSV to provide the representative product in Table II:

TABLE II

| Properties of Diesel Fuel | | |
|---|---|---|
| Gravity, ° API | 52.7 | |
| Nitrogen, ppm | 0.24 | |
| Sulfur, ppm | <1 | |
| Water, ppm by Karl Fisher, ppm | 21.5 | |
| Pour Point, ° C. | | |
| Cloud Point, ° C. | -18 | |
| Flash Point, ° C. | 58 | |
| Autoignition Temperature, ° F. | 475 | |
| Viscosity at 25° C., cSt | 2.564 | |
| Viscosity at 40° C., cSt | 1.981 | |
| Cetane Number | 74 | |
| Aromatics by Supercritical Fluid Chromatography, wt % | <1 | |
| Neutralization No. | 0 | |
| Ash Oxide, Wt % | <0.001 | |
| Ramsbottom Carbon Residue, wt % | 0.02 | |
| Cu Strip Corrosion | 1A | |
| Color, ASTM D1500 | 0 | |
| GC-MS Analysis | | |
| Paraffins, Wt % | 100 | |

TABLE II-continued

| Properties of Diesel Fuel | | |
|---|---|---|
| Paraffin i/n ratio | 2.1 | |
| Oxygen as oxygenates, ppm | <6 | |
| Olefins, Wt % | 0 | |
| Average Carbon Number | 14.4 | |
| Distillation by D-2887 by Wt %, ° F. and D-86 by Vol %, ° F. | D-2887 | D-86 |
| 0.5/5 | 255/300 | 329/356 |
| 10/20 | 326/368 | 366/393 |
| 30/40 | 406/449 | 419/449 |
| 50 | 487 | 480 |
| 60/70 | 523/562 | 510/539 |
| 80/90 | 600/637 | 567/597 |
| 95/99.5 | 659/705 | 615/630 |

In actual practice, the cloud point of the fuel can be adjusted by adjusting the end point of the fuel. Preferably the cloud point is less than 0° C., more preferably less than −15° C., and most preferably less than −25° C. While the use of pour point depressants affects primarily the pour point, it will also have an effect, albeit smaller, on the cloud point. Thus these cloud point limits are on the fuel prior to the addition of the pour point depressant.

EXAMPLE II

Effect of Pour Point Depressants

The following two pour point depressants (PPD) were mixed with the diesel fuel of Example I:

a. Plexol 156 (full designation is Viscoplex 1-256), supplied by Rohm & Haas, a polyalkyl methacrylate diluted in a solvent neutral oil; and b. TDA 1197, supplied by Texaco Fuel Additives, an ethylene vinyl acetate copolymer in an aromatic solvent.

| | PPD | | Cloud point | Pour point | Difference Cloud-Pour |
|---|---|---|---|---|---|
| Fuel | mg/kg | Type | ° C. | ° C. | ° C. |
| FT Diesel Fuel | — | | −19 | −24 | 5 |
| FT Diesel Fuel + | 1 | Plexol 156 | −19 | −24 | 5 |
| FT Diesel Fuel + | 4 | Plexol 156 | −20 | −27 | 7 |
| FT Diesel Fuel + | 30 | TDA 1197 | −18 | −24 | 6 |
| FT Diesel Fuel + | 100 | TDA 1197 | −18 | −27 | 9 |
| FT Diesel Fuel + | 300 | TDA 1197 | −18 | −36 | 18 |

Both depressants reduced the pour point, but made no significant reduction on the cloud point. Thus they can be used to reduce the pour point of a high pour point fuel, while relying on heated fuel filters to solve the problems associated with a high cloud point, as discussed earlier.

Unfortunately, the analysis of pour point depressants in fuels is difficult because they are high molecular weight compounds present in the fuel in relatively small amounts. The most effective method of determining the presence of a pour point depressant additive is by evaluating the difference between the cloud and pour points. In the presence of the additive the difference between cloud point and pour points increases from its typical value of less than about 5° C. to a value of more than about 5° C. In other embodiments the difference is more than about 10° C., and more preferably more than about 15° C.

To be effective, a pour point depressant should be used in amounts greater than about 10 mg/kg. In some embodiments the concentration of the pour point depressant is used in an amount greater than about 50 mg/kg but less than about 1000 mg/kg. In still other embodiments the pour point depressant is used in an amount greater than about 100 mg/kg but less than about 500 mg/kg. While measurement of pour point depressants in fuels is difficult, it can be done using size exclusion chromatography (SEC), preferably when the separated fractions are analyzed by an evaporative light scattering detector. This technique can determine the presence and characteristics of high molecular weight additives in fuels at concentrations over approximately 10 ppm.

Many modifications of the exemplary embodiments of the invention disclosed above will readily occur to those skilled in the art. Accordingly, the invention is to be construed as including all structure and methods that fall within the scope of the appended claims.

What is claimed is:

1. A method of enhancing operation of a diesel engine with a Fischer-Tropsch derived diesel fuel having a cloud point and a pour point, the method comprising:

adding a pour point depressant to the Fischer-Tropsch derived diesel fuel in an amount such that the difference between the cloud point and pour point of the fuel is greater than about 5° C. when the pour point is below about 0° C.; and passing the diesel fuel through a heated fuel filter when the difference between ambient temperature and the cloud point of the fuel is less than about 5° C. so that filter plugging is substantially avoided.

2. The method of claim 1, wherein the diesel fuel is passed through the heated fuel filter when the difference between the ambient temperature and the cloud point of the fuel is less than about 2° C.

3. A method of enhancing operation of a vehicle having diesel engine with a Fischer-Tropsch derived diesel fuel having a cloud point and a pour point, the method comprising:

a. adding a pour point depressant to the Fischer-Tropsch derived diesel fuel in an amount such that the difference between the cloud point and pour point of the fuel is greater than about 5° C. when the pour point is below about 0° C.; and b. passing the diesel fuel through a fuel filter wherein the filter is heated when an increase in pressure is detected across the filter and the heating is ceased when a decrease in pressure is detected across the filter.

4. The method of claim 3, wherein the filter is heated to a temperature greater than the cloud point of the fuel so that filter plugging is substantially avoided.

5. The method of claim 4, wherein the filter is heated to a temperature more than about 5° C. greater than the cloud point of the fuel.

6. The method of claim 4, wherein the filter is heated to a temperature more than about 10° C. greater than the cloud point of the fuel.

7. The method of claim 3, wherein the filter is heated with energy provided from a source within the vehicle.

8. The method of claim 1, wherein the difference between the cloud point and the pour point of the fuel is greater than about 10° C.

9. The method of claim 1, wherein the difference between the cloud point and the pour point of the fuel is greater than about 15° C.

10. The method of claim 3, wherein the difference between the cloud point and the pour point of the fuel is greater than about 10° C.

11. The method of claim 3, wherein the difference between the cloud point and the pour point of the fuel is greater than about 15° C.

* * * * *